US007343652B1

(12) United States Patent
Liu

(10) Patent No.: US 7,343,652 B1
(45) Date of Patent: Mar. 18, 2008

(54) LACE ADJUSTER

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 11/522,450

(22) Filed: Sep. 18, 2006

(51) Int. Cl.
*A43C 7/08* (2006.01)

(52) U.S. Cl. ..... 24/712.5; 24/712.2

(58) Field of Classification Search ..... 24/712.1, 24/712.2, 712.5, 712.9, 122.6, 132 R, 134 R, 24/136 K; 36/50.1
See application file for complete search history.

(56) References Cited

U.S. PATENT DOCUMENTS 849,921 A * 4/1907 Schelling ..... 24/712.5
1,066,751 A * 7/1913 Park ..... 24/134 R
2,861,314 A * 11/1958 Applebaum ..... 24/712.2
5,388,315 A * 2/1995 Jones ..... 24/712.1
5,535,531 A * 7/1996 Karabed et al. ..... 36/50.1
6,178,606 B1 * 1/2001 Glendon ..... 24/712.5
2003/0167609 A1 * 9/2003 Christy ..... 24/712.9

* cited by examiner

*Primary Examiner*—Robert J. Sandy
(74) *Attorney, Agent, or Firm*—Birch, Stewart, Kolasch & Birch, LLP

(57) ABSTRACT

An adjustable lace assembly includes a lace, a tubular member, two stop members, and two spaced apart inserting pins. The lace is composed of two separate lace segments each having a tagged end and an opposite bent end portion. The tubular member has a passage for receiving the bent end portions. The stop members are mounted pivotally inside the tubular member at two axially spaced apart positions and span the passage. Each of the stop members has an engaging part engageable with one of the bent end portions. The inserting pins are insertable removably into the tubular member, are capable of disengaging the bent end portions, respectively, from the engaging parts of the stop members, and permit movement of the bent end portions so that a length between the tagged end of each of the lace segments and a corresponding one of the stop members can be adjusted.

7 Claims, 7 Drawing Sheets

LACE ADJUSTER

BACKGROUND OF THE INVENTION

1. Field of the Invention

The invention relates to a lace adjuster, more particularly to a lace adjuster for adjusting a length of a lace easily. The invention also relates to an adjustable lace assembly including the lace adjuster.

2. Description of the Related Art

A conventional lace for a shoe has two opposite tagged ends and a fixed length. Therefore, the length of the conventional lace cannot be adjusted according to the number of the eyelets and the size of the shoe.

Referring to FIGS. 1 and 2, a conventional adjustable lace assembly includes a tubular member 1 and a lace 2. The tubular member 1 is formed in a substantially cylindrical shape, and includes a surrounding wall 102 defining a passage 101. The surrounding wall 102 has a first end 103, a second end 104 opposite to the first end 103, an inner surface 105 extending between the first and second ends 103, 104 and proximate to the passage 101, and a plurality of stop anchors 106 extending inclinedly relative to the surrounding wall 102 and extending from the inner surface 105 toward the passage 101. The lace 2 has a tagged end portion 202 and a stringing end portion 201 opposite to the tagged end portion 202.

The lace 2 will move relative to the tubular member 1 along a direction (X) from the first end 103 toward the second end 104 when the stringing end portion 201 of the lace 2 is pulled along the direction (X). The stringing end portion 201 of the lace 2 can be stopped by the stop anchors 106 after the stringing end portion 201 of the lace 2 stringing through the passage 101 of the tubular member 1. In this manner, the length of the lace 2 from the tagged end portion 202 to the tubular member 1 can be adjusted by changing the length of the stringing end portion 201 that extends out of the second end 104 of the tubular member 1.

Although the length of the lace 2 from the tagged end portion 202 to the tubular member 1 is adjustable, in order to provide the stop anchors 106 with sufficient stop effect and structural strength, the tubular member 1 should be made of metal via a plurality of processing steps, such as punching, rolling, etc. Therefore, the production cost for the tubular member 1 is relatively high.

SUMMARY OF THE INVENTION

Therefore, one object of the present invention is to provide a lace adjuster which is simple in structure and which is easy to operate.

Another object of this invention is to provide an adjustable lace assembly including the lace adjuster.

In one aspect of this invention, a lace adjuster is used for adjusting a length of a lace composed of two separate lace segments each having a tagged end and an opposite bent end portion. The lace adjuster includes a tubular member, two stop members, and two inserting pins. The tubular member includes a surrounding wall defining an axially extending passage adapted to receive the bent end portions of the lace segments, two pairs of diametrically opposite pin-inserting holes, and two pairs of diametrically opposite pivot holes. The surrounding wall has opposite first and second open ends, an inner surface extending between the first and second open ends, and an outer surface opposite to the inner surface. The two pairs of the pin-inserting holes are axially spaced apart from each other between the first and second open ends. Each pair of the pin-inserting holes extends through the inner and outer surfaces. Each pair of the pivot holes is positioned between one of the first and second open ends and a corresponding pair of the pin-inserting holes. The stop members are inserted into the passage, and each of the stop members is jointed pivotally into one pair of the pivot holes. Each of the stop members has an engaging part adapted to engage the bent end portion of one of the lace segments. Each of the inserting pins is insertable removably into one pair of the pin-inserting holes to disengage the bent end portion of one of the lace segments from the engaging part of a corresponding one of the stop members.

In another aspect of this invention, an adjustable lace assembly includes a tubular member, two stop members, a lace, and two inserting pins. The tubular member includes a surrounding wall defining a passage extending in an axial direction, two pairs of diametrically opposite pin-inserting holes, and two pairs of diametrically opposite pivot holes. The surrounding wall has opposite first and second open ends, an inner surface extending between the first and second open ends, and an outer surface opposite to said inner surface. The two pairs of the pin-inserting holes are spaced apart from each other in the axial direction between the first and second open ends. Each pair of the pin-inserting holes extends through the inner and outer surfaces. Each pair of the pivot holes is positioned between one of the first and second open ends and a corresponding pair of the pin-inserting holes. The stop members are inserted into the passage, and each of the stop members is jointed pivotally into one pair of the pivot holes. Each of the stop members has an engaging part. The lace is composed of two separate lace segments, each of which has a tagged end and an opposite bent end portion. The bent end portions of the lace segments are inserted into the passage. Each of the bent end portions turns around one of the stop members and is engageable with the engaging part of said one of the stop members. Each of the inserting pins is insertable removably into one pair of the pin-inserting holes to disengage the bent end portion of one of the lace segments from the engaging part of a corresponding one of the stop members so that the bent end portion is permitted to move for adjustment of a length between the tagged end of each of the lace segments and a corresponding one of the stop members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
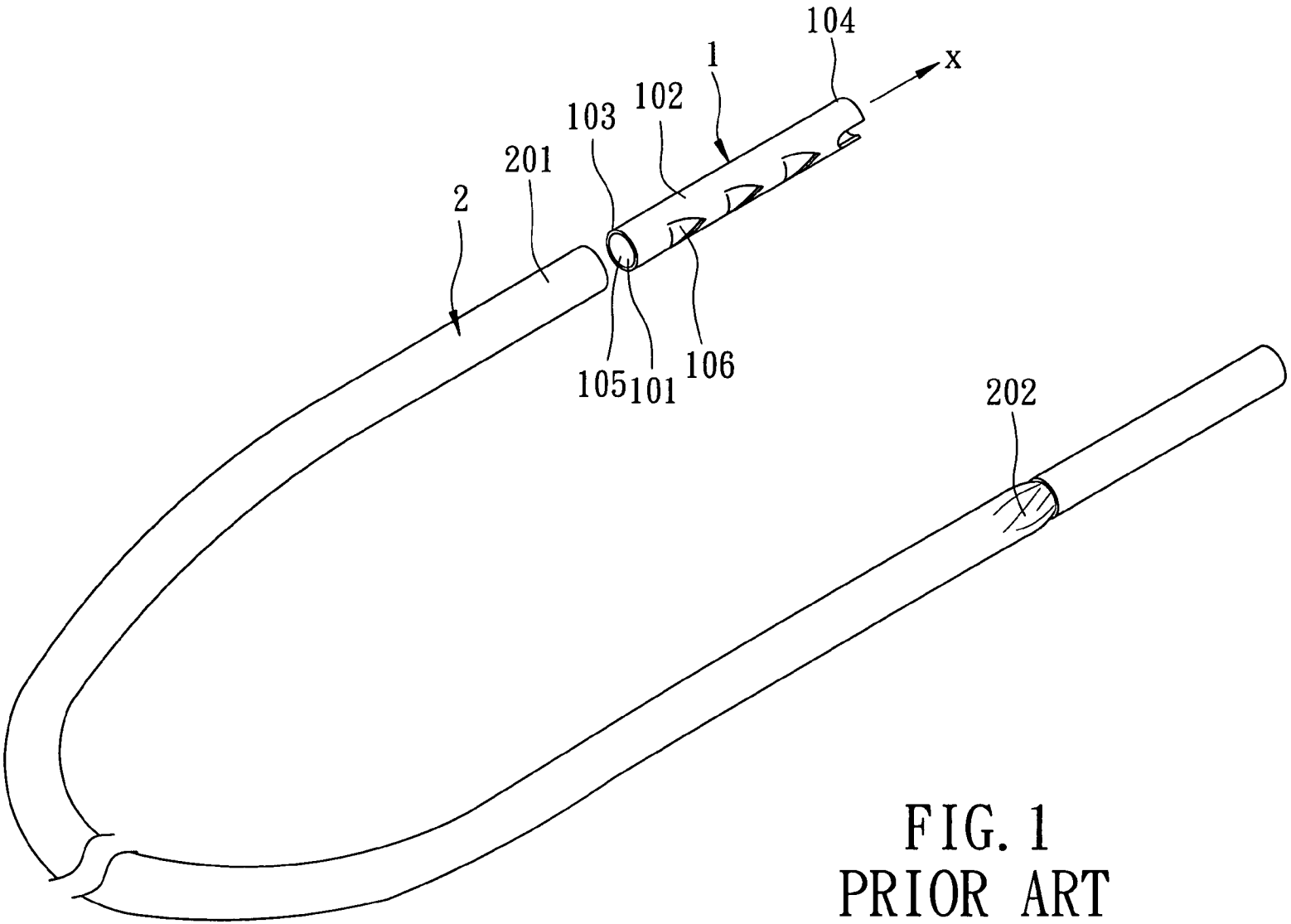
FIG. 1 PRIOR ART
FIG. 1 is a fragmentary perspective view of an adjustable lace assembly disclosed in Taiwanese Patent No. I250854.
Figure 2:
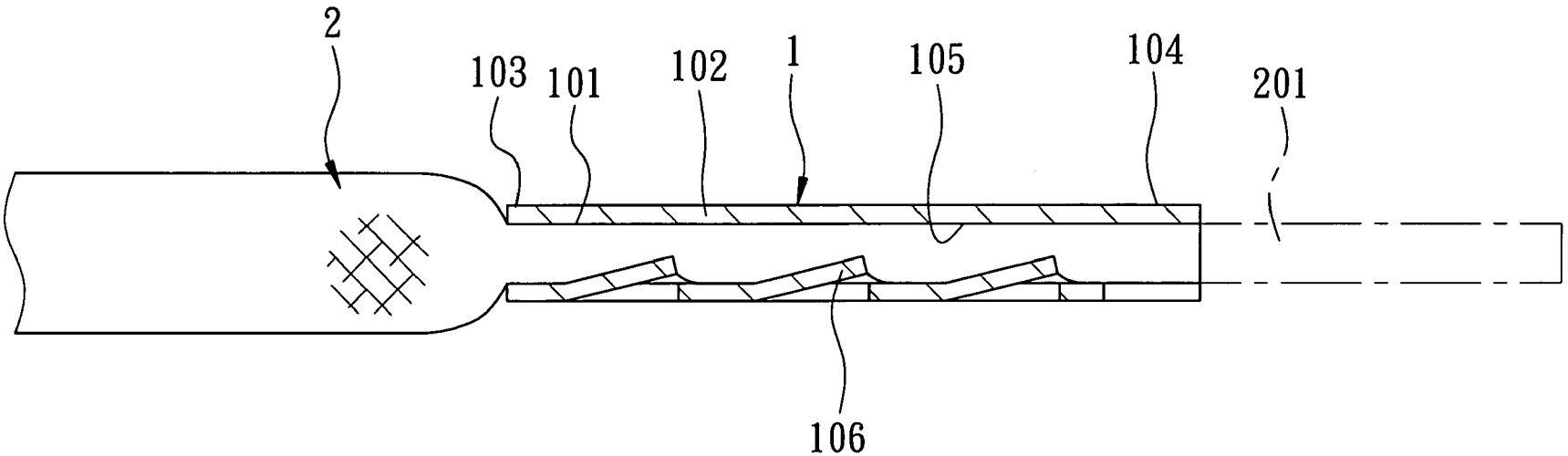
FIG. 2 PRIOR ART
FIG. 2 is a fragmentary partly sectional view of FIG. 1.
Figure 3:
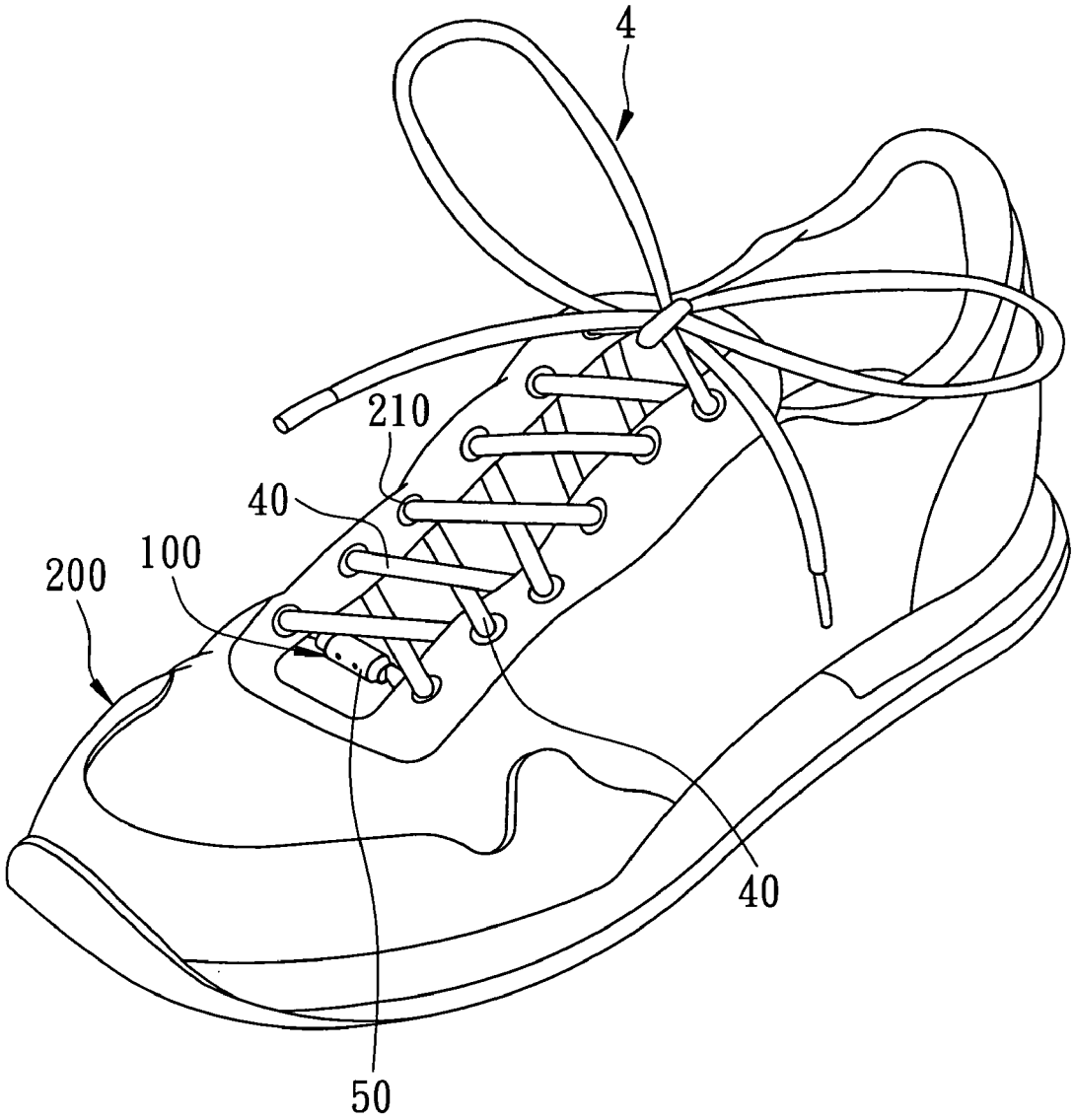
FIG. 3 is a perspective view of the preferred embodiment of the adjustable lace assembly according to this invention used with a shoe body.
Figure 4:
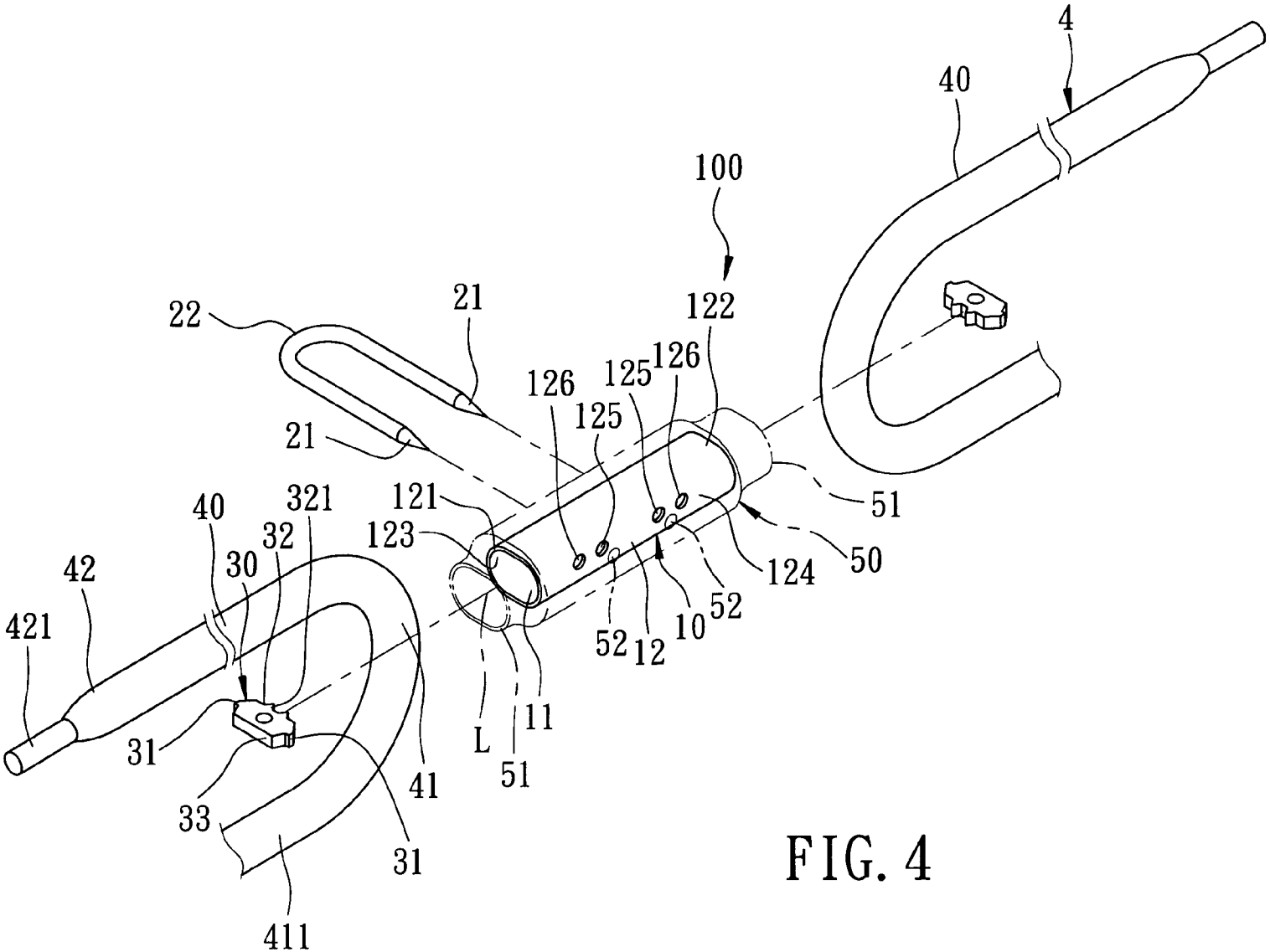
FIG. 4 is an exploded fragmentary perspective view of the preferred embodiment.

Referring to FIGS. 3 and 4, the preferred embodiment of an adjustable lace assembly 100 according to this invention is shown to be applied to a shoe body 200 that has a plurality of eyelets 210. The adjustable lace assembly 100 includes a tubular member 10, two stop members 30, a lace 4, two inserting pins 21, and a cover member 50.

The tubular member 10 is formed as a tube having a substantially oval cross-section, and includes a surrounding wall 12 defining a passage 11 extending in an axial direction (L), two pairs of diametrically opposite pin-inserting holes 125, and two pairs of diametrically opposite pivot holes 126. The surrounding wall 12 has opposite first and second open ends 121, 122, an inner surface 123 extending between the first and second open ends 121, 122, and an outer surface 124 opposite to the inner surface 123. The two pairs of the pin-inserting holes 125 are spaced apart from each other in the axial direction (L) between the first and second open ends 121, 122. Each pair of the pin-inserting holes 125 extends through the inner and outer surfaces 123, 124. Each pair of the pivot holes 126 is positioned between one of the first and second open ends 121, 122 and a corresponding pair of the pin-inserting holes 125.

The stop members 30 are inserted into the passage 11, and each of the stop members 30 is jointed pivotally into one pair of the pivot holes 126. Each of the stop members 30 includes a plate 33 having two pivoting ends 31 protruding oppositely and inserted into the pivot holes 126, respectively, and an engaging part 32 extending between the pivoting ends 31. The engaging part 32 of each of the stop members 30 has two teeth 321 spaced apart from each other and protruding away from one of the first and second open ends 121, 122 of the surrounding wall 12. In the preferred embodiment, the stop members 30 are made of a metal plate.

The lace 4 is composed of two separate lace segments 40. Each of the lace segments 40 includes a tagged end portion 42 having a tagged end 421, and an opposite bent end portion 41 having an adjusting end portion 411 opposite to the tagged end portion 42. The bent end portions 41 of the lace segments 40 are inserted into the passage 11 of the tubular member 10. Each of the bent end portions turns around one of the stop members 30 and is adapted to engage the engaging part 32 of said one of the stop members 30.

Each of the inserting pins 21 is insertable removably into one pair of the pin-inserting holes 125 to disengage the bent end portion 41 of one of the lace segments 40 from the engaging part 32 of a corresponding one of the stop members 30 so that the bent end portion 41 is permitted to move for adjustment of a length between the tagged end 421 of each of the lace segments 40 and a corresponding one of the stop members 30. In this embodiment, the inserting pins 21 are formed as one piece and have a U-shaped connection 22 therebetween.

The cover member 50 covers the tubular member 10, and includes two open ends 51 extending beyond the first and second open ends 121, 122 of the surrounding wall 12 of the tubular member 10, respectively. The cover member 50 has two pairs of diametrically opposite through holes 52. Each pair of the through holes 52 is aligned radially with one of the pairs of the pin-inserting holes 125. In the preferred embodiment, the cover member 50 is made of a plastic material.

Figure 5:
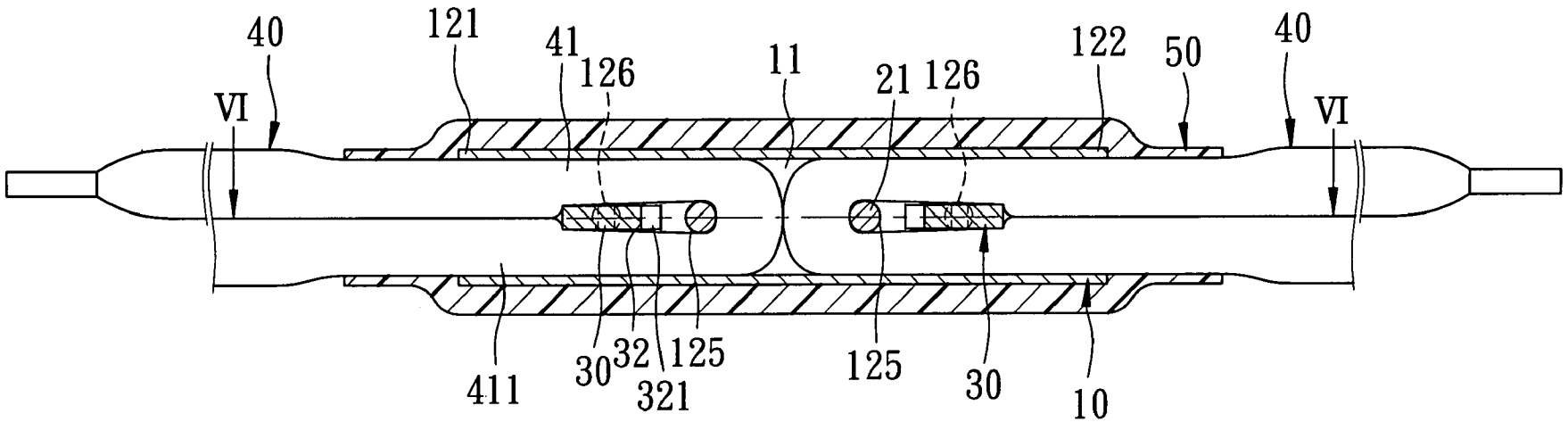
FIG. 5 is a fragmentary sectional view of the preferred embodiment.
Figure 6:
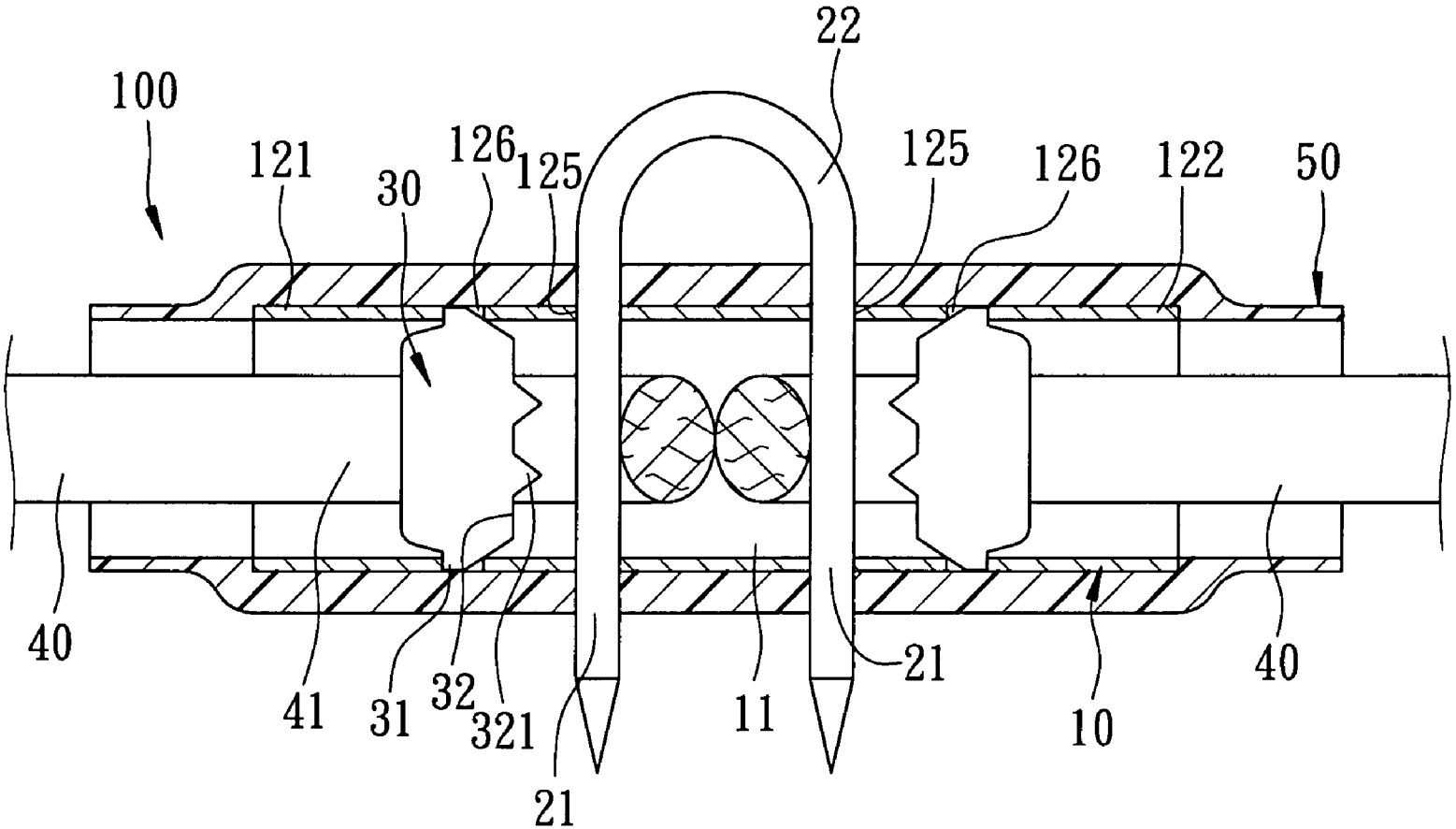
FIG. 6 is a fragmentary sectional view taken along line VI-VI in FIG. 5.

Referring to FIGS. 5 and 6, in assembly, the bent end portions 41 of the lace segments 40 are inserted into the passage 11 of the tubular member 10 via the first and second open ends 121, 122, respectively until the bent end portions 41 of the lace segments 40 are disposed between the pin-inserting holes 125. The inserting pins 21 are inserted into the pin-inserting holes 125 correspondingly, and the stop members 30 are inserted into the passage 11 of the tubular member 10 and are jointed pivotally into the pivot holes 126 correspondingly so as to finish the assembly of the adjustable lace assembly 100.

The adjustable lace assembly 100 is installed on the shoe body 100 by stringing the lace segments 40 through the eyelets 210. If the overall length of the lace 4 is too long, the bent end portion 41 of each of the lace segments 40 can be guided around the corresponding one of the inserting pins 31 by pulling the adjusting end portion 411 of each of the bent end portions 41 out the tubular member 10. In this manner, the length between the tagged end 421 of each of the lace segments 40 and a corresponding one of the stop members 30 can be adjusted to a desirable length.

Figure 7:
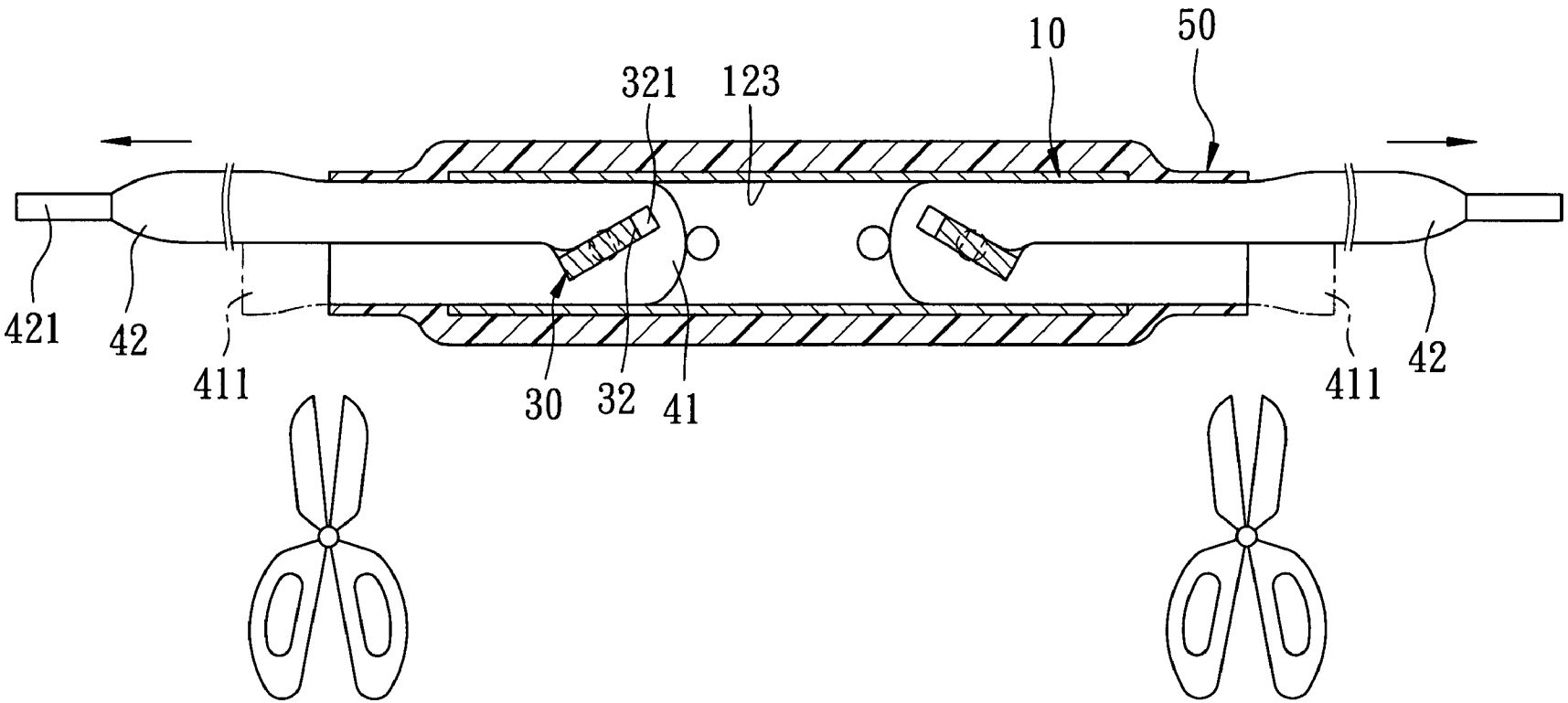
FIG. 7 is a fragmentary sectional view illustrating the operation of the preferred embodiment.

Referring to FIGS. 6 and 7, after adjusting the lengths of the lace segments 40, the inserting pins 31 are removed from the pin-inserting holes 125 so that the bent end portion 41 of each of the lace segments 40 abuts against the engaging part 32 of a corresponding one of the stop members 30. When the adjusting end portion 411 of each of the lace segments 40 is further pulled, each of the stop members 30 can rotate so as to stop the bent end portion 41 of a corresponding one of the lace segments 40. Finally, the adjusting end portions 411 of the lace segments 40 that extend out of the tubular member 10 can be cut for aesthetic purposes.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lace adjuster adapted for adjusting a length of a lace composed of two separate lace segments each having a tagged end and an opposite bent end portion, said lace adjuster comprising:

a tubular member including a surrounding wall defining an axially extending passage adapted to receive the bent end portions of the lace segments, said surrounding wall having opposite first and second open ends, an inner surface extending between said first and second open ends, and an outer surface opposite to said inner surface, said tubular member having two pairs of diametrically opposite pin-inserting holes, and two pairs of diametrically opposite pivot holes, said two pairs of said pin-inserting holes being axially spaced apart from each other between said first and second open ends, each pair of said pin-inserting holes extending through said inner and outer surfaces, each pair of said pivot holes being positioned between one of said first and second open ends and a corresponding pair of said pin-inserting holes;

two stop members inserted into said passage and each jointed pivotally into one pair of said pivot holes, each of said stop members having an engaging part adapted to engage the bent end portion of one of the lace segments; and two inserting pins each of which is insertable removably into one pair of said pin-inserting holes to disengage the bent end portion of one of the lace segments from said engaging part of a corresponding one of said stop members.

2. The lace adjuster as claimed in claim 1, wherein said engaging part of each of said stop members includes at least one tooth protruding away from one of said first and second open ends of said surrounding wall.

3. The lace adjuster as claimed in claim 1, further comprising a cover member covering said tubular member and including two open ends extending beyond said first and second open ends of said surrounding wall, respectively, said cover member having two pairs of diametrically opposite through holes, each pair of said through holes being aligned radially with one of said pairs of said pin-inserting holes.

4. The lace adjuster as claimed in claim 1, wherein said inserting pins are formed as one piece and have a U-shaped connection therebetween.

5. The lace adjuster as claimed in claim 1, wherein each of said stop members includes a plate having two pivoting ends protruding oppositely and inserted into said pivot holes, respectively.

6. An adjustable lace assembly, comprising:

a tubular member including a surrounding wall defining a passage extending in an axial direction, said surrounding wall having opposite first and second open ends, an inner surface extending between said first and second open ends, and an outer surface opposite to said inner surface, said tubular member having two pairs of diametrically opposite pin-inserting holes, and two pairs of diametrically opposite pivot holes, said two pairs of said pin-inserting holes being spaced apart from each other in said axial direction between said first and second open ends, each pair of said pin-inserting holes extending through said inner and outer surfaces, each pair of said pivot holes being positioned between one of said first and second open ends and a corresponding pair of said pin-inserting holes;

two stop members inserted into said passage and each jointed pivotally into one pair of said pivot holes, each of said stop members having an engaging part;

a lace composed of two separate lace segments each having a tagged end and an opposite bent end portion, said bent end portions of said lace segments being inserted into said passage, each of said bent end portions turning around one of said stop members and being engageable with said engaging part of said one of said stop members; and two inserting pins each of which is insertable removably into one pair of said pin-inserting holes to disengage said bent end portion of one of said lace segments from said engaging part of a corresponding one of said stop members so that said bent end portion is permitted to move for adjustment of a length between said tagged end of each of said lace segments and a corresponding one of said stop members.

7. An adjustable lace assembly, comprising:

a lace composed of two separate lace segments each having a tagged end and an opposite bent end portion;

a tubular member having a passage for receiving said bent end portions of said lace segments;

two stop members mounted pivotally inside said tubular member at two axially spaced apart positions and spanning said passage, each of said stop members having an engaging part engageable with one of said bent end portions; and two spaced apart inserting pins insertable removably into said tubular member, and being capable of disengaging said bent end portions, respectively, from said engaging parts of said stop members and permitting movement of said bent end portions so that a length between said tagged end of each of said lace segments and a corresponding one of said stop members can be adjusted.

* * * * *